US005588890A

United States Patent [19]

Garofalo

[11] Patent Number: 5,588,890

[45] Date of Patent: Dec. 31, 1996

[54] SWIMMING FIN

[75] Inventor: Giovanni Garofalo, Rapallo, Italy

[73] Assignee: HTM Sport S.p.A., Italy

[21] Appl. No.: 438,912

[22] Filed: May 10, 1995

[30] Foreign Application Priority Data

May 20, 1994 [IT] Italy ..... GE94A0062

[51] Int. Cl.[6] ..... A63B 31/11

[52] U.S. Cl. ..... 441/64

[58] Field of Search ..... 441/61–64

[56] References Cited

U.S. PATENT DOCUMENTS 3,922,741 12/1975 Semeia ..... 441/64

5,163,859 11/1992 Beltrani ..... 441/61

5,324,219 6/1994 Beltrani et al. ..... 441/64

FOREIGN PATENT DOCUMENTS 0310828 4/1989 European Pat. Off. .

2937347 6/1980 Germany .

2128096 4/1984 United Kingdom .

93/22004 11/1993 WIPO ..... 441/64

*Primary Examiner*—Sherman Basinger

*Attorney, Agent, or Firm*—Larson and Taylor

[57] ABSTRACT

Swimmimg fin of the type having an open shoe comprising a shoe portion (201) and a blade portion (101), in which the top surface (211) of the sole of said shoe portion (201) comprises two or more longitudinal ribs (121) projecting into the interior of the shoe portion (201).

8 Claims, 2 Drawing Sheets

SWIMMING FIN

BACKGROUND AND SUMMARY OF THE INVENTION

The present invention relates to swimming fins, especially swimming fins of the type having an open shoe.

More particularly, the invention relates to this type of swimming fin formed with a shoe portion of a flexible elastomeric material and a blade portion of a relatively stiffer material. In particular, the inner top surface of the sole of the shoe portion is of a flexible elastomeric material.

These fins are often worn with special rubber boots.

However, the resulting fin has a number of disadvantages, such as a lack of stability especially in the lateral direction owing to slippage between the boot and fin. Furthermore, between the top surface of the sole of the shoe portion and the necessary boot for wearing these fins, considerable friction is created because of the material of which the top surface of the sole is made, thereby making the action of putting these fins on uncomfortable.

The object of the invention is therefore a fin of the type described above that can be put on easily and has improved stability once on.

The subject of the present invention is therefore a swimming fin of the type having an open shoe comprising a shoe portion and a blade portion, characterized in that the top surface of the sole of said shoe portion comprises two or more broad longitudinal ribs projecting into the interior of the shoe portion of said fin, that supports the user's foot.

Another object of the invention is a boot provided with a sole having longitudinal grooves complementary to the ribs projecting from the top surface of the sole of the shoe portion of the fin according to the invention.

Advantageously, in the case of fins made of two materials, one being more flexible and of an elastomeric type and the other relatively stiffer, these ribs are made of the stiffer material.

BRIEF DESCRIPTION OF THE DRAWINGS

Further advantages and characteristics will appear clearly in the following detailed description of an embodiment of the present invention made, for illustrative purposes and without implying any restriction, with reference to the accompanying drawings, in which.

DESCRIPTION OF THE PREFERRED EMBODIMENT OF THE INVENTION

Figure 1:
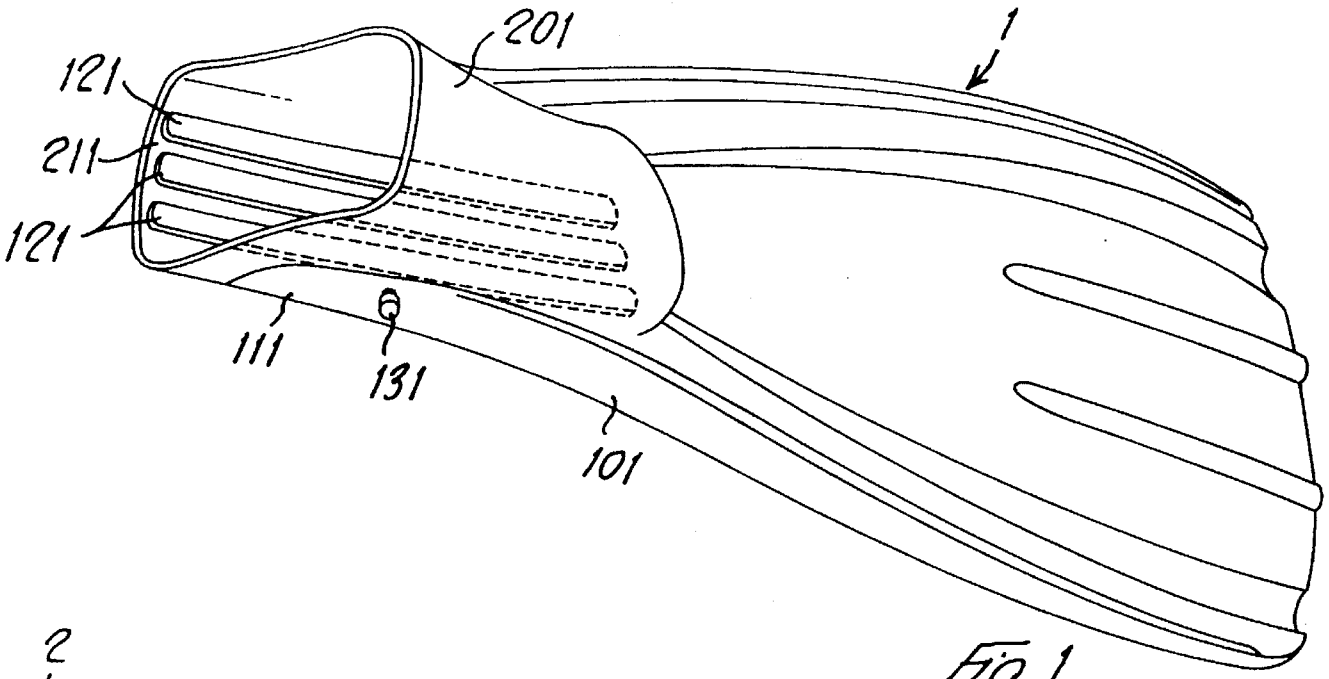
FIG. 1 is a perspective view of a swimming fin according to the present invention.

In FIG. 1, the numeral 1 denotes a swimming fin according to the invention provided with a blade portion 101 and a shoe portion 201. In the case illustrated, the blade portion 101 is made of a stiffer material and extends underneath the top surface 211 of the sole of the shoe portion 201, to form the sole part 111 (see also FIG. 3). Through the elastomeric material of which the top surface 211 of the sole of said shoe portion 201 is made, project raised elements such as three longitudinal ribs 121 integral with the inner face of the sole part 111 of the blade portion 101.

Figure 2:
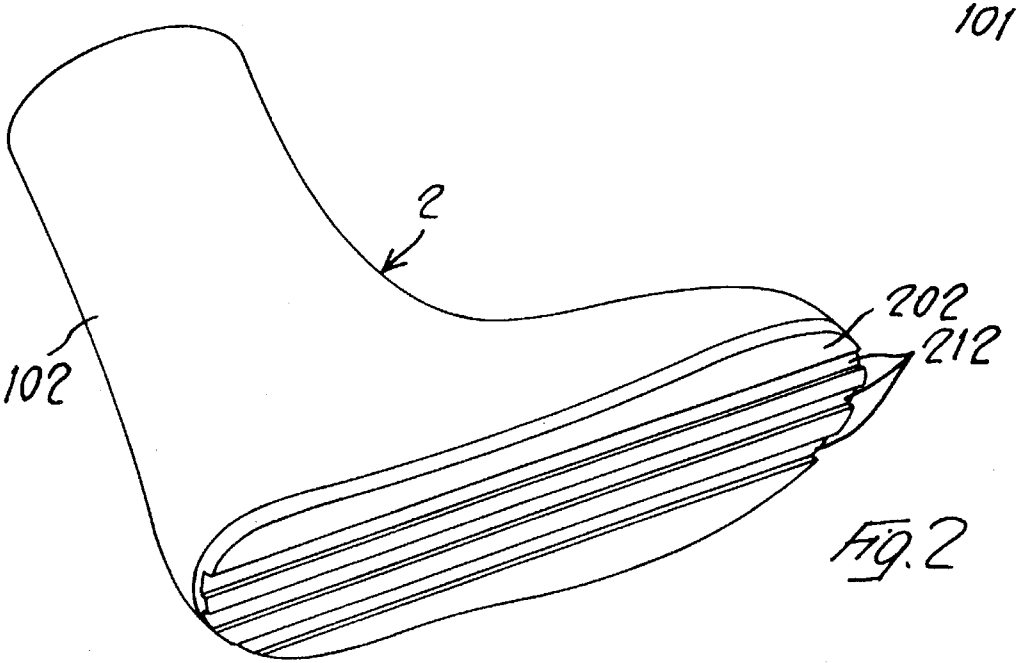
FIG. 2 is a perspective view of a boot suitable for use with a fin of the type illustrated in FIG. 1.

FIG. 2 shows a boot 2 which is to be used for wearing the fin 1 shown in FIG. 1. This boot comprises an upper 102 provided with a sole 202, said sole 202 being provided with three longitudinal grooves 212.

Figure 3:
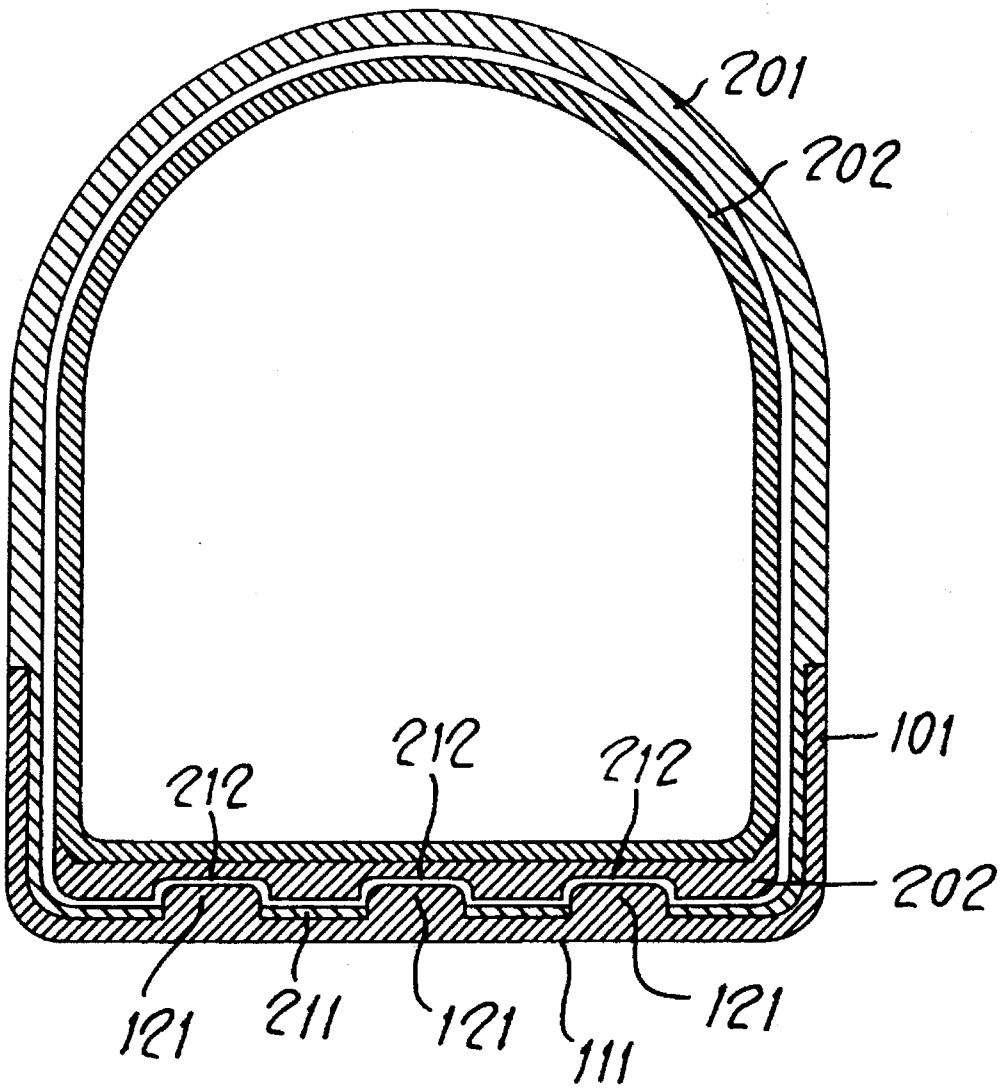
FIG. 3 is a cross section of the shoe portion of the fin of FIG. 1, with the boot (also in section) inside the fin.

Lastly, FIG. 3 shows how the longitudinal grooves 212 of the sole 202 of the boot 2, and the longitudinal ribs 121 projecting from the sole part 111 of the blade portion 101 through the top surface 211 of the sole of the shoe portion 201, fit together.

For a user, therefore, putting on a fin according to the invention is much easier: the ribs 121 of stiffer plastic material reduce the possibility of friction between the top portion 211 of the sole of the shoe portion 201 and the sole of a boot, of whatever type the latter may be.

In particular, if the boot used is of the kind shown in FIG. 2, not only will it be easier to put the fin 1 on, but also the combined fin and boot will be made very stable by the fitting together of the ribs 121 of the top portion 211 of the sole of the shoe portion of the fin and the grooves 212 of the sole 202 of the boot 2. The sole 202 can be made from the same material as the upper part 102 of the boot, or from a stiffer material.

In this way, not only is the insertion of the boot into the fin made easier, but greater lateral stability of the resulting fin/boot unit is also ensured.

Naturally, although a fin made of two materials has been described, it will be understood that the invention can also be applied to a fin made from one material only, as for example one having the blade and shoe in elastomer or rubber.

I claim:

1. Swimming fin of the type having an open shoe comprising:

a shoe portion having a sole, and a blade portion, wherein a top interior surface of said sole is provided with two or more longitudinal ribs, said shoe portion is of a flexible material and said blade portion is of a relatively stiffer material, said blade portion extends underneath the top interior surface of said sole of said shoe portion to form a sole part, and said ribs are formed on said sole part, from which they project into an interior of the said shoe portion.

2. Swimming fin according to claim 2, in combination with a boot comprising an upper provided with a sole having longitudinal grooves complementary to said ribs of the fin.

3. Swimmimg fin according to claim 2, in which said upper of said boot is made of a flexible material, whereas said sole of said booth is made of a relatively stiffer material.

4. Swimming fin according to claim 1 wherein said longitudinal ribs are elongated and extend upwardly into the interior of the shoe portion.

5. In combination, a swimming fin of the type having an open shoe and a boot which fits into the open shoe, said boot having a sole which has a sole bottom, and said open shoe comprising a shoe portion that has a sole and a blade portion, the sole of the shoe portion having a sole top, each of the sole top and the sole bottom including longitudinal ribs, wherein said ribs of the sole bottom and the sole top cooperate with each other to readily facilitate longitudinal sliding movement of the boot into and out of the shoe portion and prevent lateral slippage of the boot and shoe portion relative to each other.

6. The combination as claimed in claim 5, including grooves formed between said ribs on each sole so as to fit in a complementary fashion with the ribs on the other sole.

7. A swim fin comprising:

an open shoe including a sole, a top and a side which form an enclosed interior shoe area with an open back; a blade extending forwardly from the open shoe;

said sole having longitudinal ribs projecting into said interior shoe area, said ribs being separated by grooves, whereby said open back and ribs and grooves are adapted to receive a boot with complementary ribs and grooves on a bottom thereof, such that said boot is slidable into and out of said open back of said open shoe.

8. A swim fin according to claim 7 wherein said longitudinal ribs are elongated and extend upwardly into the enclosed interior shoe area.

* * * * *